US006995735B2

(12) United States Patent
Mizobata

(10) Patent No.: US 6,995,735 B2
(45) Date of Patent: Feb. 7, 2006

(54) DRIVE METHOD OF AC TYPE PLASMA DISPLAY PANEL

(75) Inventor: Eishi Mizobata, Tokyo (JP)

(73) Assignee: NEC Corporation, Tokyo (JP)

( * ) Notice: Subject to any disclaimer, the term of this patent is extended or adjusted under 35 U.S.C. 154(b) by 371 days.

(21) Appl. No.: 10/296,806

(22) PCT Filed: Jun. 1, 2001

(86) PCT No.: PCT/JP01/04647

§ 371 (c)(1),
(2), (4) Date: Jun. 20, 2003

(87) PCT Pub. No.: WO01/95302

PCT Pub. Date: Dec. 13, 2001

(65) Prior Publication Data

US 2004/0051683 A1 Mar. 18, 2004

(30) Foreign Application Priority Data

Jun. 2, 2000 (JP) ..... 2000-166631

(51) Int. Cl.
*G09G 3/28* (2006.01)

(52) U.S. Cl. ..... 345/60; 345/66; 345/67; 345/68

(58) Field of Classification Search ..... 345/60–68, 345/89–94, 204, 690, 208–215; 315/169.1–169.4; 313/581–586
See application file for complete search history.

(56) References Cited

U.S. PATENT DOCUMENTS

| | | | | |
|---|---|---|---|---|
| 5,835,072 | A | 11/1998 | Kanazawa | |
| 6,181,305 | B1 * | 1/2001 | Nguyen et al. | 345/60 |
| 6,219,013 | B1 * | 4/2001 | Amano | 345/60 |
| 6,288,693 | B1 * | 9/2001 | Song et al. | 345/68 |

FOREIGN PATENT DOCUMENTS

JP 09-81073 A 3/1997

OTHER PUBLICATIONS

H. Hirakawa et al., "19.2: Cell structure and Driving Method of a 25-inch. (64-cm) Diagonal High-Resolution Color ac Plasma Display ", *SID 98 Digest* , May, 1998, pp. 280-282.

* cited by examiner

*Primary Examiner*—Vijay Shankar
(74) *Attorney, Agent, or Firm*—Sughrue Mion, PLLC

(57) ABSTRACT

A method for driving an AC plasma display panel which makes it possible to reduce flicker in display and have stable and high luminance. In a first step, a wall charge of same amount is produced both in an X electrode 22 and a Y electrode 23 by writing discharge during a scanning period. At this time, the amount of the wall charge is adjusted depending on gray scale to be displayed. In a second step, during a sustaining period, a timing of a start of the sustaining discharge is changed by changing a sustaining start control voltage as a voltage of a data electrode. Gradation sequence are displayed through the above steps.

21 Claims, 7 Drawing Sheets

DRIVE METHOD OF AC TYPE PLASMA DISPLAY PANEL

TECHNICAL FIELD

The present invention relates to a method for driving an AC (alternating current) type plasma display panel.

BACKGROUND ART

Generally, a plasma display panel (hereinafter, referred to as a PDP) incorporates many features in that it can be made thin, it can comparatively easily display a large screen, it can provide a wide-range viewing angle, it can provide a high response speed or a like. Therefore, in recent years, it is used for a wall-mounted television, public display plate or a like in a form of a flat display device. The PDP can be classified, by operation mode, into two groups; one being a DC (direct current)-type PDP adapted to be operated with its electrode being exposed to discharge space (that is, to discharge gas) and in a direct current discharging condition and another being an AC-type PDP adapted to be operated with its electrode coated with dielectric layers and without its electrode being directly exposed to discharging gas and in an alternating current discharge condition. In the DC-type PDP, discharge occurs while a voltage is being applied. In the AC-type PDP, discharge is sustained by changing a polarity of a voltage to be applied. Moreover, in the AC-type PDP, a number of electrodes contained in one cell is two or three.

Configurations and driving method of a conventional three-electrode AC-type PDP are described below. FIG. 2 is a cross-sectional view of one example of a cell used for a conventional PDP. The conventional three-electrode AC-type PDP includes a front substrate 20 and a rear substrate 21 both of which are placed opposite to each other, a plurality of X electrodes 22, Y electrodes 23, and data electrodes 29 being disposed between the front substrate 20 and the rear substrate 21, and display cells being disposed at each of intersections of the X electrodes 22, the Y electrodes 23, and the data electrodes 29.

As the front substrate 20, a glass substrate or a like is used. Each of the X electrodes 22 and each of the Y electrodes 23 are placed at a specified interval. On these X electrodes 22 and Y electrodes 23 is formed a transparent dielectric layer 24. On the transparent dielectric layer 24 is formed a protective layer 25 made up MgO (Magnesium oxide) or a like adapted to protect the transparent dielectric layer 24 from discharging. On the other hand, as the rear substrate 21, a glass substrate or a like is used. Each of the data electrodes 29 is so mounted as to be perpendicular to each of the X electrodes 22 and to each of the Y electrodes 23.

On the data electrodes 29 is formed a white dielectric layer 28. On the while dielectric layer 28 is formed a phosphor layer 27. Between front substrate 20 and rear substrate 21 is placed a partition wall (not shown) at a specified interval in parallel to a face of paper. The partition wall is used to secure discharge space 26 and to demarcate pixels. The discharge space 26 is filled, in a sealed manner, with mixed gas such as He (Helium), Ne (Neon), Xe (Xenon) or a like, as discharge gas to be used for discharge. The conventional three-electrode AC-type PDP having such configurations as described above is disclosed in SID (Society for Information Display) 98 DIGEST (P279–281, May, 1998).

FIG. 3 is a plan view of the conventional three-electrode AC-type PDP. As shown in FIG. 3, at each of intersections of each electrode Xi (i=1 to m) making up the X electrodes 22 and each electrode Yi (i=1 to m) making up the Y electrodes 23 and each electrode Dj (j=1 to n) making up the data electrode 29, each of display cells is disposed. These display cells are placed in a matrix form.

Next, a conventional method for driving a PDP will be described below. As the method for driving the PDP, a scanning/sustaining separation method (ADS method) an which a scanning period and a sustaining period are separated is in the present mainstream. However, this method requires a plurality of sub-fields (SF) for displaying a gray shade and also requires the scanning period for each of the SFs. Therefore, if the number of gray scales Or the number of scanning lines is increased, the scanning period forms an increasing proportion of one field and, as a result, the sustaining period forms a decreasing proportion of one field, causing low luminance in display. To solve this problem, an alternative method for driving the PDP by which the gray shade can be displayed by one time scanning without using such SFs is proposed. The method of this type for driving the PDP is disclosed, for example, in Japanese Unexamined Patent Application Publication No. 9-81073. The scanning/sustaining separation method will be described below. FIG. 1 is a diagram showing waveforms explaining driving operations of the conventional three-electrode AC-type PDP. One field 1 is made up of three periods including a preliminary discharge period 2, a scanning period 3, and a sustaining period 4.

First, the preliminary discharge period 2 will be described. A preliminary discharge pulse 5 with positive polarity is applied to the X electrode 22 and a preliminary discharge pulse 6 with negative polarity is applied to the Y electrode 23. This enables resetting of irregularity caused by light emitting conditions in a pre-field period, in a state in which wall charges occur at a final stage of a pre-SF and enables all pixels to be forcedly discharged, thus providing a priming effect which induces subsequent writing discharge to occur at a lower voltage. Moreover, though, in the example shown in FIG. 1, both the preliminary discharge pulses 5 and 6 are applied once with same timing, in some cases, two kinds of pulses each having a different role are applied, that is, a priming pulse to cause all pixels to be discharged and priming effects to be implemented is applied after a sustainment extinguishing pulse to cause the stat of the pre-field to be reset has been applied. At this point, in some cases, a different sustainment extinguishing pulse is applied not only once but also two or more numbers of times. Furthermore, through, in the example shown in FIG. 1, to extinguish the wall charge produced by the preliminary discharge, a self-extinguishing process by using a fall of each of the preliminary discharge pulses is employed, in some cases, a preliminary discharge extinguishing pulse is applied to extinguish these wall charges separately. In some cases, the preliminary discharge extinguishing pulse is also applied not only once but also two or more numbers of times. Moreover, in some cases, these pulses are applied to other electrodes. In any case, the wall charge on the dielectric layer produced by the preliminary discharge is extinguished or is controlled to be propre in quantity.

Next, the scanning period 3 is described below. During the scanning period 3, a scanning pulse 8 with negative polarity is applied sequentially to each of electrodes (X1 to Xm) making up the X electrodes 22. At the same time when the scanning pulse 8 is applied, a data pulse 10 is applied, so as to correspond to a display pattern, to each of electrodes (D1 to Dn) making up the data electrodes 29. The data pulse 10 changes a pulse voltage depending on gray scale to be displayed. In the case of a gray scale with low luminance, the pulse voltage is set to a low level and, then, the voltage is boosted as luminance becomes higher. When application of the scanning pulse 8 is completed, a wall charge being almost equivalent to a potential difference between the scanning pulse 8 and the data pulse 10 is accumulated by writing discharge. Therefore, a large amount of the wall charge is accumulated in a pixel into which a signal with high luminance has been input and a small amount of the wall charge is accumulated in the pixel into which a signal with low luminance has been input. A scanning base voltage 7 being applied to the scanning electrode 22 during the scanning period is applied to prevent erroneous discharging that may occur, after the writing discharge, between the X electrode 22 and the Y electrode 23 of a pixel being adjacent to the X electrode 22 (that is, between non-discharging gaps).

After the scanning pulse 8 has been applied to all lines, a sustaining period 4 starts. Each of the sustaining pulses 11 is applied alternately to all of the X electrodes and all of the Y electrodes. Voltages of the sustaining pulses 11 are increased step by step during the sustaining period. As a result, potential difference between the X electrode 22 and the Y electrode 23 increases as their polarities are reversed. However, this voltage is set to a level at which discharge does not occur. Therefore, since an amount of the wall charge is small in a pixel in which writing discharge has not occurred, even when the sustaining pulses are applied, no discharge occurs. On the other hand, in the pixel in which the writing discharge occurs, the wall charge is accumulated in the X electrode 22 to correspond to a gray shade. During the sustaining period 4, a voltage resulting from superposition of a voltage produc d by the wall charge accumulated in th X electrode 22 by the writing discharge on the potential difference between the sustaining pulses 11 is applied between the X electrode 22 and the Y electrode 23. Since the sustaining voltage is increased step by step, when it exceeds a start voltage for surface discharge at some point in time, the surface discharge occurs between the X electrode 22 and the Y electrode 23. At this time, since a data bias voltage 12 is applied to the data electrode 29, no opposite discharge occurs. Once the surface discharge occurs, a large amount of the wall charge with reverse polarity is accumulated in the X electrode 22 and the Y electrode 23. The accumulated wall charge, since the subsequent sustaining pulse voltage with reverse polarity is superposed on the wall charge, produces a large potential difference, thus causing the surface discharge with reverse polarity to occur again and a large amount of the wall charge with reverse polarity to be again accumulated. Thus, once the surface discharge occurs, every time the polarity of the sustaining pulse is reversed, the surface discharge is repeated until the sustaining period 4 ends.

A timing of a start of the surface discharge changes depending on an amount of the wall charge accumulated by the writing discharge. That is, if the amount of the wall charge is small, the sustaining pulse with a high voltage is required and the surface discharge does not start until the sustaining pulse 11 with the high voltage produced at a later stage of the sustaining period 4 is applied, while, if the amount of the wall charge is large, the surface discharge starts when the sustaining pulse with a low voltage is applied. Thus, a period while light is emitted (that is, the period while discharge occurs) can be changed during the sustaining period 4 depending on the amount of the wall charge. The amount of the wall charge is produced by the writing discharge at a time of writing depending on the gray scale to be displayed. Thus, a period while light is emitted can be controlled depending on the gray scale. The gray scale is displayed under such control.

As described above, in the conventional example, the writing discharge occurs only in the X electrodes 22 during the scanning period, and lighting or non-lighting is decided depending on a difference between the amount of the wall charge produced in the X electrode 22 and the amount of the wall charge produced in the Y electrode 23. In order to realize this, it is required to set the sustaining pulse voltage in a prescribed range.

For lighting pixels, the sustaining pulse voltage is required to be the minimum sustaining voltage Vsm or higher at which the sustaining discharge continues. On the other hand, for non-lighting pixels, since the discharge is required not to occur while the wall charge is not produced, the sustaining pulse voltage is required to be lower than a discharge start voltage Vf. Although depending on configurations and dimensions of a cell, materials of gas, etc., generally the minimum sustaining voltage Vsm is around 130 V and the discharge start voltage Vf is around 190 V. Therefore, the sustaining pulse voltage is allowed in the range of around 130 to 190 V. As in the conventional example described above, when the display of the gray scale is performed by scanning of one time, the sustaining pulse voltage is required to be set in some stages. Then, the upper limit and the lower limit are given and, as a result, the number of gray scales to be set is only a few in the range of 60 V.

Moreover, for example, when four gray scales are displayed, the sustaining pulse voltages are set in the range of 140 V to 180 V at a step of 20 V. A 0th gray scale gray scale is defined as black and a third gray scale is defined as while. Then, if it is assumed that the sustaining discharge occurs at a time when the sustaining pulse voltage in a first gray scale reaches 180 V, a potential difference of 20 V as the sustaining pulse voltage is too small a margin, and accordingly when a sustaining pulse voltage of 160 V is applied, weak discharge may occur. Therefore, conditions of the wall charge at a time of writing (the amount of the wall charge decreases) and, in some cases, the sustaining discharge may occur even when a sustaining pulse 11 of 180 V is applied. This fact causes flicker in display. Furthermore, since luminance in the sustaining discharge is dependent on the sustaining pulse voltage, the luminance level at 140 V is low and is likely to become unstable. Moreover, not only the luminance level is simply proportional to the number of pulses, but also the total luminance level is suppressed so as to be low.

In view of the above, it is an object of the present invention to provide a method for driving an AC plasma display panel which makes it possible to reduce flicker in display and have stable and high luminance.

DISCLOSURE OF INVENTION

In order to attain the above object, a method for driving an AC-type plasma display panel according to the present invention comprises the following steps. X electrodes and Y electrodes are mounted on one of two insulating substrates placed opposite to each other so as to be disposed alternately and parallel to each other. Data electrodes are mounted on the other of the two insulating substrates so as to be perpendicular to both the X electrodes and the Y electrodes. Pixels are formed at intersections of the X electrodes and Y electrodes and the data electrodes in a matrix form. During a scanning period, writing discharge producing wall charges based on gradation sequence to be displayed is caused to occur sequentially. A voltage of same polarity and same level is applied to the X electrode and Y electrode of the pixels at timing when a data pulse corresponding to data to be displayed of the pixels is applied to the data electrodes. During a sustaining period, sustaining discharge occurs by applying, during a sustaining period, a sustaining pulse for inducing light emitting for displaying alternately to each of the X electrodes and each of the Y electrodes based on the wall charges.

Furthermore, another method for driving an AC-type plasma display panel according to the present invention comprises the following steps. X electrodes and Y electrodes are mounted on one of two insulating substrates placed opposite to each other so as to be disposed alternately and parallel to each other. Data electrodes are mounted on the other of the two insulating substrates so as to be perpendicular to both the X electrodes and the Y electrodes. Pixels are formed at intersections of the X electrodes and Y electrodes and the data electrodes in a matrix form. During a scanning period, writing discharge producing wall charges based on gradation sequence to be displayed is caused to occur sequentially. During the scanning period, a wall charge of same polarity and same amount is produced in the X electrode and the Y electrode of the pixels. During a sustaining period, a sustaining pulse is applied alternately to each of the X electrodes and each of the Y electrodes to induce sustaining discharge which induces light emitting for displaying.

Furthermore, another method for driving an AC-type plasma display panel according to the present invention comprises the following steps. X electrodes and Y electrodes are mounted on one of two insulating substrates placed opposite to each other so as to be disposed alternately and parallel to each other. Data electrodes are mounted on the other of the two insulating substrates so as to be perpendicular to both the X electrodes and the Y electrodes. Pixels are formed at intersections of the X electrodes and Y electrodes and the data electrodes in a matrix form. During a scanning period, writing discharge producing wall charges based on gradation sequence to be displayed is caused to occur sequentially. A voltage of the wall charge produced in the X electrode and the Y electrode of the pixels during the scanning period, the voltage added to a voltage of the sustaining pulse which does not cause surface discharge between the X electrode and the Y electrode, is produced. During a sustaining period, a sustaining pulse is applied alternately to each of the X electrodes and each of the Y electrodes to induce sustaining discharge which induces light emitting for displaying.

By the sustaining pulse applied at an initial stage of the sustaining period, opposite discharge occurs between the data electrode and either of the X electrode and the Y electrode in lighting pixels and no discharge occurs in non-lighting pixels.

A voltage of the data pulse applied to the data electrode at a time the writing charge in the scanning period is made different depending on gradation sequence to be displayed. An amount of the wall charge produced by the writing discharge is adjusted. Gradation sequence are displayed such that, during the sustaining period, a potential of the data electrode is changed and timing of a start of the sustaining discharge is changed depending on the gradation sequence.

During the sustaining period, discharge at timing of a start of the sustaining discharge depending on gradation sequence is the opposite discharge between the X electrode and the data electrode or the Y electrode and the data electrode.

In the opposite discharge, the data electrode is positive.

Wall charges are produced in the X electrode and the Y electrode before the writing discharge in the scanning period occurs. The writing discharge is caused to occur by extinguishing writing to adjust the wall charges at a time when the data pulse is applied.

Wall charges are produced in the X electrode and the Y electrode by surface discharge between the X electrode and the Y electrode before the writing discharge occurs in the scanning period.

The X electrode and the Y electrode are at a same potential when the data pulse is applied for causing the writing discharge to occur.

A potential difference between the electrodes where the opposite discharge occurs at timing of a start of the sustaining discharge is increased gradually during the sustaining period.

The sustaining pulse voltage is constant and a potential difference between the electrodes where the opposite discharge occurs at timing of a start of the sustaining discharge is increased gradually during the sustaining period by changing a potential of the data electrode.

During the sustaining period, a potential difference between the electrodes where the opposite discharge occurs at timing of a start of the sustaining discharge is increased gradually by changing, step by step, the potential of the data electrode.

A potential of the data electrode except timing of a start of the sustaining discharge is set between a potential of the data electrode at timing of a start of an initial sustaining discharge during the sustaining period and a potential of the sustaining pulse.

A potential of the data electrode changing step by step and a potential of the data pulse applied during the scanning period are made common.

Each of the preliminary discharge period which resets the wall charge in the sustaining period, the scanning period, and the sustaining period is defined as one sub-field, and a plurality of the sub-fields makes up one field to display one screen.

Each of the sustaining periods making up the one sub-field within one field has sustaining pulses in different number.

All of the number of sustaining pulses in each of the sub-fields in the one field during a period from a start of the sustaining discharge to an end of the sustaining period, is different in the one field.

A width of the sustaining pulse at timing of a start of the sustaining discharge is wider than a width of the other sustaining pulses.

BEST MODE FOR CARRYING OUT THE INVENTION

Figure 2:
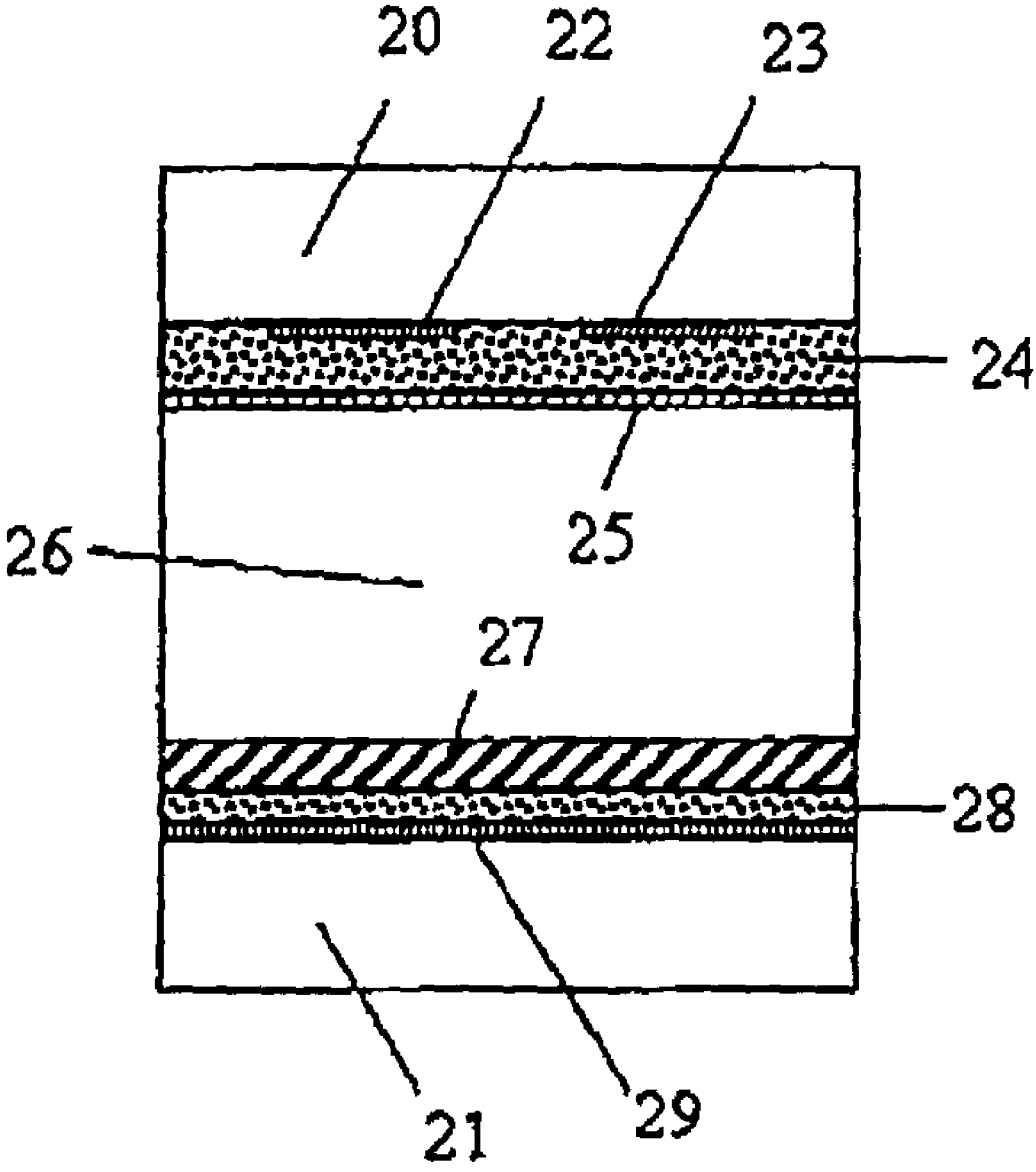
FIG. 2 is a cross-sectional view of one example of a cell used for the conventional tree-electrode AC-type PDP.
Figure 3:
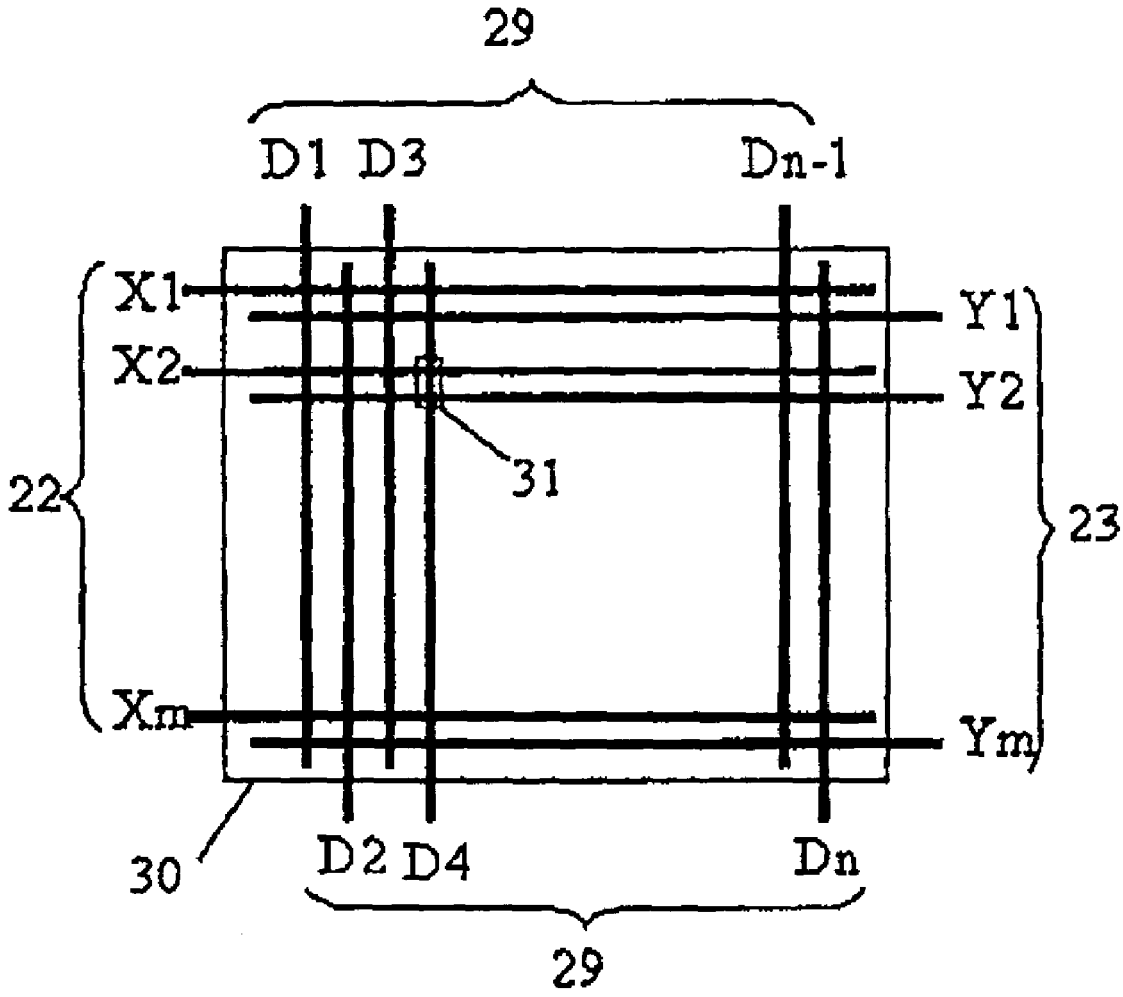
FIG. 3 is a plan view of the conventional three-electrode AC-type PDP.
Figure 4:
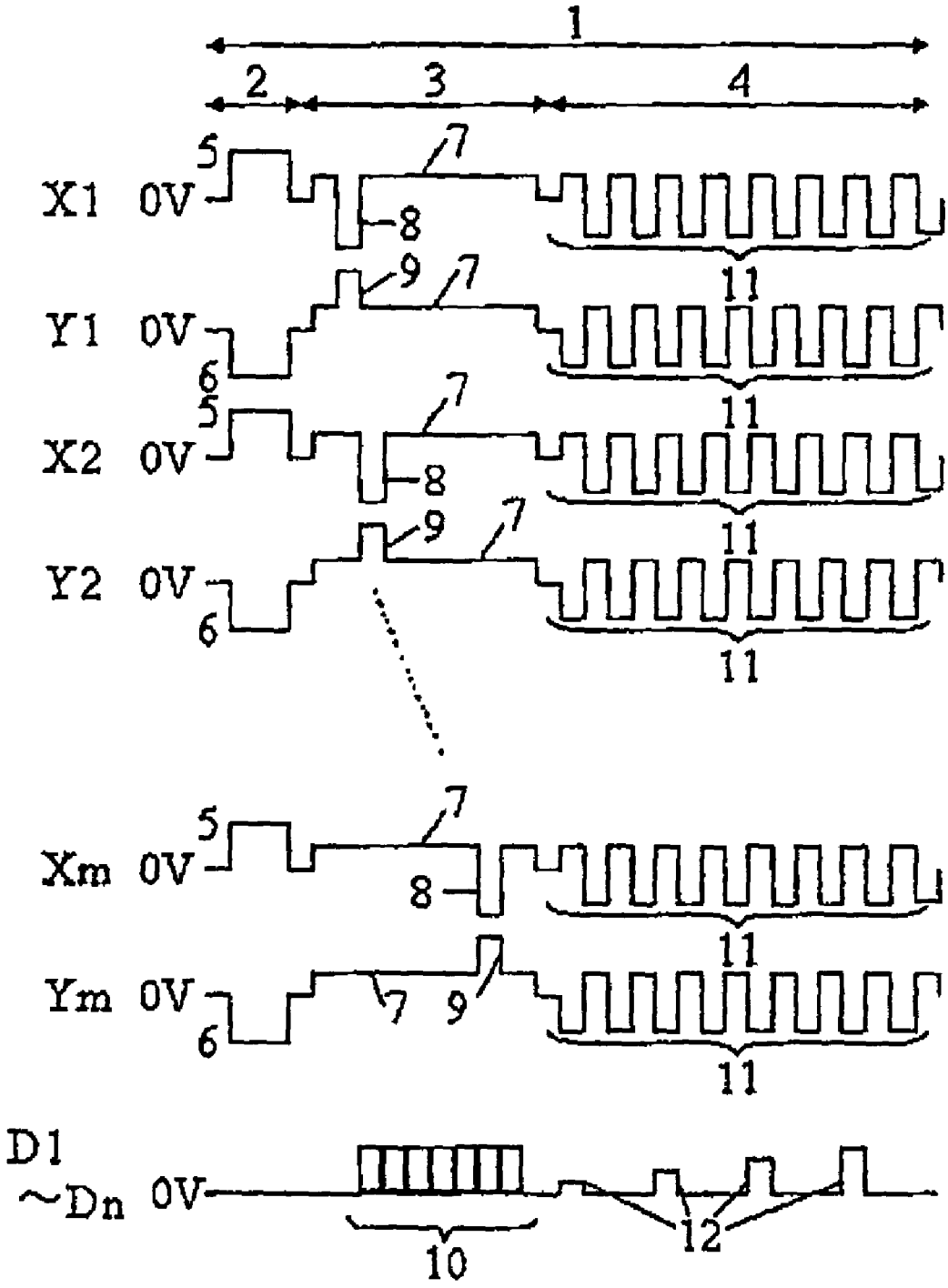
FIG. 4 is a diagram of waveforms explaining driving of a three-electrode AC-type PDP according to a first embodiment of the present invention.

Hereinafter, a first embodiment of the present invention will be described with reference to the is accompanying drawings. FIG. 4 is a diagram of wave forms explaining scanning/sustaining separation-type driving of a three-electrode AC-type PDP according to the first embodiment. Configurations of the AC-type PDP and its cells of the first embodiment are the same as those shown in FIGS. 2 and 3. In this embodiment, cell dimensions and discharge gas conditions are set so that a start voltage for an opposite discharge in which an X electrode 22 is used as a negative electrode is 190 V, a start voltage for the opposite discharge in which the data electrode 29 is used as the negative electrode is 270 V, and a start voltage for a surface discharge is 190 V. Specifically, a gap interval for the opposite discharge is set at 100 μm, a gap interval for a face discharge is set at 100 μm, a thickness of a transparent dielectric layer 24 is 30 μm, a thickness of a white dielectric layer 28 is 10 μm, and a thickness of a phosphor layer is about 20 μm. Discharge gas is composed of He and Ne in a ratio of 0.7:0.3 and Xe (3%). Gas pressure is 500 Torr.

Figure 1:
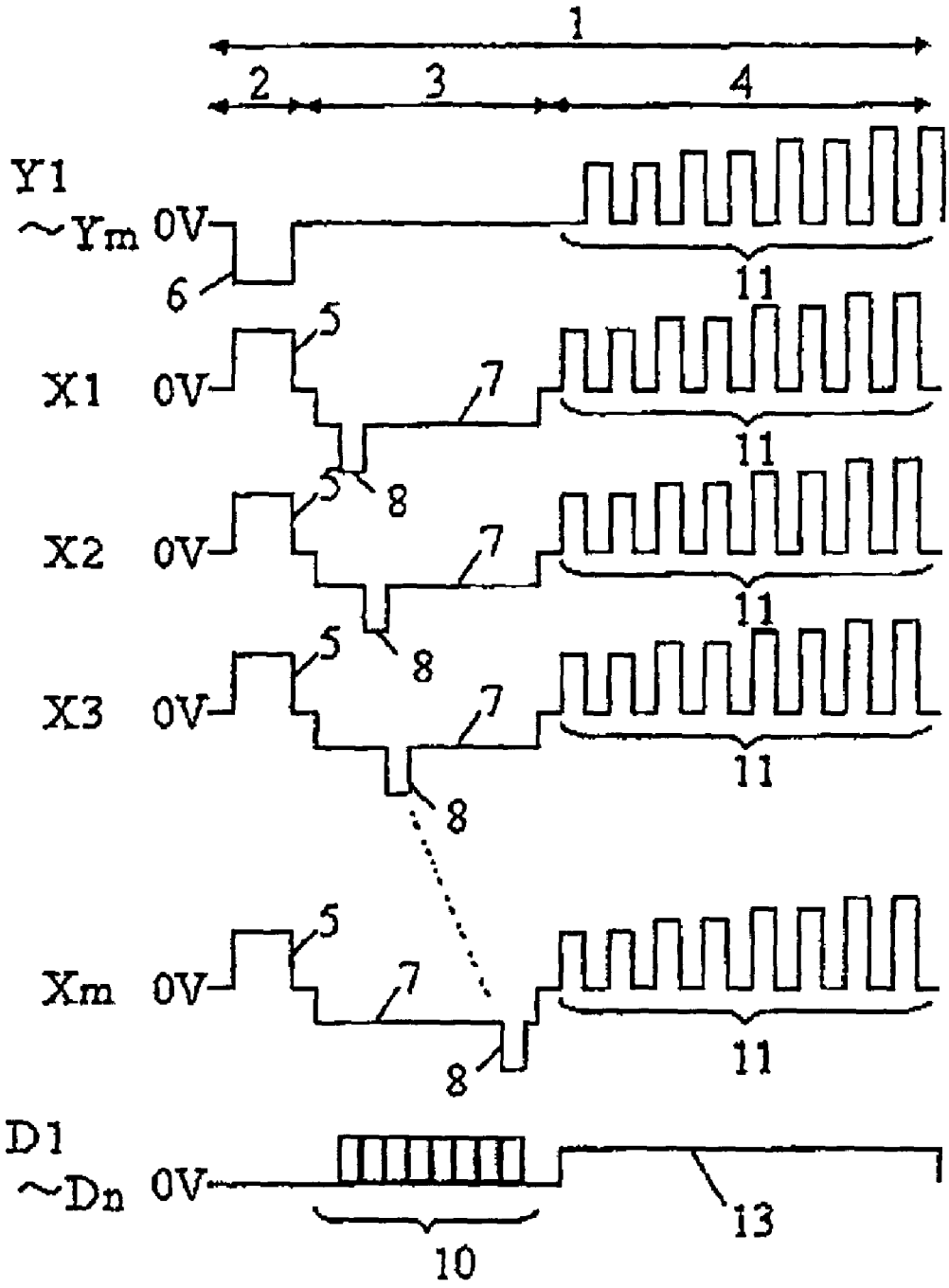
FIG. 1 is a diagram showing waveforms explaining driving operations of a conventional three-electrode AC-type PDP.

Preliminary discharge period 2 and scanning period 3 are the same as those in the conventional case shown in FIG. 1. A voltage of a preliminary discharge pulse 5 with positive polarity is set at 200 V and a voltage of a preliminary discharge pulse 6 with negative polarity is set at −200 V. Pulse width of these pulses is set at 4 to 6 μsec. During the scanning period 3, a scanning bias voltage with a voltage of about 80 V is being applied to the X electrode and the Y electrode.

A scanning pulse 8 with a voltage of about −160 V is applied sequentially to the X electrodes of X1 to Xm. On the other hand, a scanning pulse 9 with a voltage of about 160 V is applied sequentially to the Y electrodes of Y1 to Ym at the same time as that of the scanning pulse 8. A width of both the scanning pulses is set at 2.0 to 3.0 μsec. A data pulse 10 corresponding to an image signal is applied in synchronization with the scanning pulses 8 and 9. A voltage of the data pulse is 0 to 80 V and is 80 V for a 0th shade of gray (black) and 0 V for a 4th shade of gray (white) and the voltage from 80 V to 0 V is set in 20 V step so as to correspond to each of the 0th to 4th gradation sequence so that five gradation sequence are displayed.

After all the scanning pulses 8 and 9 have been applied, the sustaining period 4 starts. During the sustaining period 4, a sustaining pulse 11 with a voltage of 80 V is applied to the X electrode 22 and a sustaining pulse 11 with a voltage of 90 V is applied to the 7 electrode 23, alternately. During the sustaining period 4, a sustaining discharge start control voltage 12 depending on the gray shade is applied to the data electrode at a timing where a sustaining discharge starts in accordance with each of gradation sequence. Here, the sustaining discharge start control voltage 12 is set at 20 V, 40 V, 60 V, and 80 V in the order from start so as to be the same as the data pulses 10. A width of the sustaining pulse is 3 to 5 μsec. In FIG. 4, although they have the same pulse width, the opposite discharge can be made to occur more surely such that the pulse width at a timing when the sustaining discharge start control voltage 12 is applied is lengthened to be 10 to 20 μsec.

Operations during the preliminary discharge period 2 are the same as those in the conventional case and description of them are omitted therefore. Subsequent to the preliminary discharge period 2, the scanning period 3 starts. During the scanning period 3, the scanning pulses are applied to the X electrodes and the Y electrodes. A surface discharge occurs between the X electrode and the Y electrode. A large positive wall charge is produced in the X electrode 22 and a large negative wall charge is produced in the Y electrode 23. With the fall after the application has been finished, a data pulse is applied depending on the gray shade. The potential of the X electrode and the Y electrode becomes the same scanning base voltage 7. With an extinguishing discharge, the wall charge of same amount is produced. The wall charges substantially of same voltage and with opposite polarity to the data electrode 29 are produced in the X electrode 22 and the Y electrode 23. For example, when the data pulse 10 is 0 V, a potential difference between the X electrode 22 and Y electrode 23 and the data electrode 29 becomes 80 V. Therefore, a wall charge of −40 V, equivalent to half of the potential difference, is produced in the X electrode 22 and the Y electrode 23. A wall charge of +40 V is produced in the data electrode 29. In the same way, when the data pulse 10 is 20 V, a wall charge of −30 V is produced in the X l ctrode 22 and the Y electrode 23, and a wall charge of +30 V is produced in the data electrode 29. In the case of 40 V, a wall charge of −20 V is produced in the X electrode 22 and the Y electrode 23, and a wall charge of +20 V is produced in the data electrode 29. In the case of 60 V, a wall charge of −10 V is produced in the X electrode 22 and the Y electrode 23, and a wall charge of +10 V is produced in the data electrode 29. In the case of 80 V, no wall charge is produced in the X electrode 22, the Y electrode 23, and in the data electrode 29.

After the scanning period 3 ends, the sustaining period 4 starts. During the sustaining period 4, although the potential difference is reversed between the X electrode 22 and the Y electrode 23, they are kept at 170 V. Therefore, when a wall charge of the same amount is produced, no surface discharge occurs. On the other hand, when 20 V which is the initial sustaining discharge start control voltage 12 during the sustaining period 4 is applied to the data electrode 29, a potential difference between the Y electrode 23 and the data electrode 29 becomes 110 V. During the scanning period 3, when the data pulse 10 is 0 V, a wall charge of the Y electrode 23 is added to a wall charge of the data electrode 29, resulting in 80 V. this 80 V is superposed on 110 V as the potential difference between the Y electrode 23 and the data electrode 29, resulting in 190 V. Therefore, the opposite discharge occurs. However, even when any wall charge which is smaller than that is superposed on the pulse, since the superposed voltage does not exceed the opposite discharge start voltage, no discharge occurs. When this opposite discharge occurs, a large positive wall charge is produced in the Y electrode 23.

On the other hand, since a negative wall charge is produced in the X electrode 22 at a time of writing, a next wall charge is applied. At a time when the X electrode 22 becomes negative and the X electrode 23 becomes positive, a surface discharge occurs between the X electrode 22 and the Y electrode 23. After that, each time the polarities are reversed, a surface discharge occurs. The sustaining discharge continues until the sustaining period ends. In the same way, when a sustaining discharge start control voltage 12 of 40 V is applied, the potential difference between the Y electrode 23 and the data electrode 29 becomes 130 V. During the scanning period 3, when the data pulse 10 is 20 V, a wall charge on the Y electrode 23 and a wall charge on the data electrode 29 are added, resulting in 60 V. This 60 V is superposed on 130 V as a potential difference between the Y electrode 23 and the data electrode 29, resulting 190 V. Then, the opposite discharge occurs. However, even when any wall charge which is less than that is superposed on the pulse, since the added voltage does not exceed the opposite discharge start voltage, no discharge occurs.

In the same way, if the sustaining discharge start control voltage 12 becomes 60 V, discharge occurs when the data pulse becomes 40 V. If the sustaining discharge start control voltage 12 becomes 80 V, discharge occurs when the data pulse 10 becomes 60 V. Lastly, no sustaining discharge occurs when the data pulse 10 is 80 V. Thus, the display of the gradation sequence can be implemented such that timing of the start of the sustaining discharge is controlled by the data pulse voltage and that the period in which the sustaining discharge occurs is changed.

In the present invention, there are no voltage restrictions due to the sustaining pulse voltage different from the conventional example, and the range of the sustaining discharge start control voltage 12, that is, the range of the data electrode can be increased. Furthermore, the voltage of the sustaining pulse 11 is constant during the sustaining period, and weak and unstable sustaining discharge around the minimum sustaining voltage is not required to be used. Moreover, luminance of the gradation sequence can be simply decided by the number of sustaining pulses.

Figure 5:
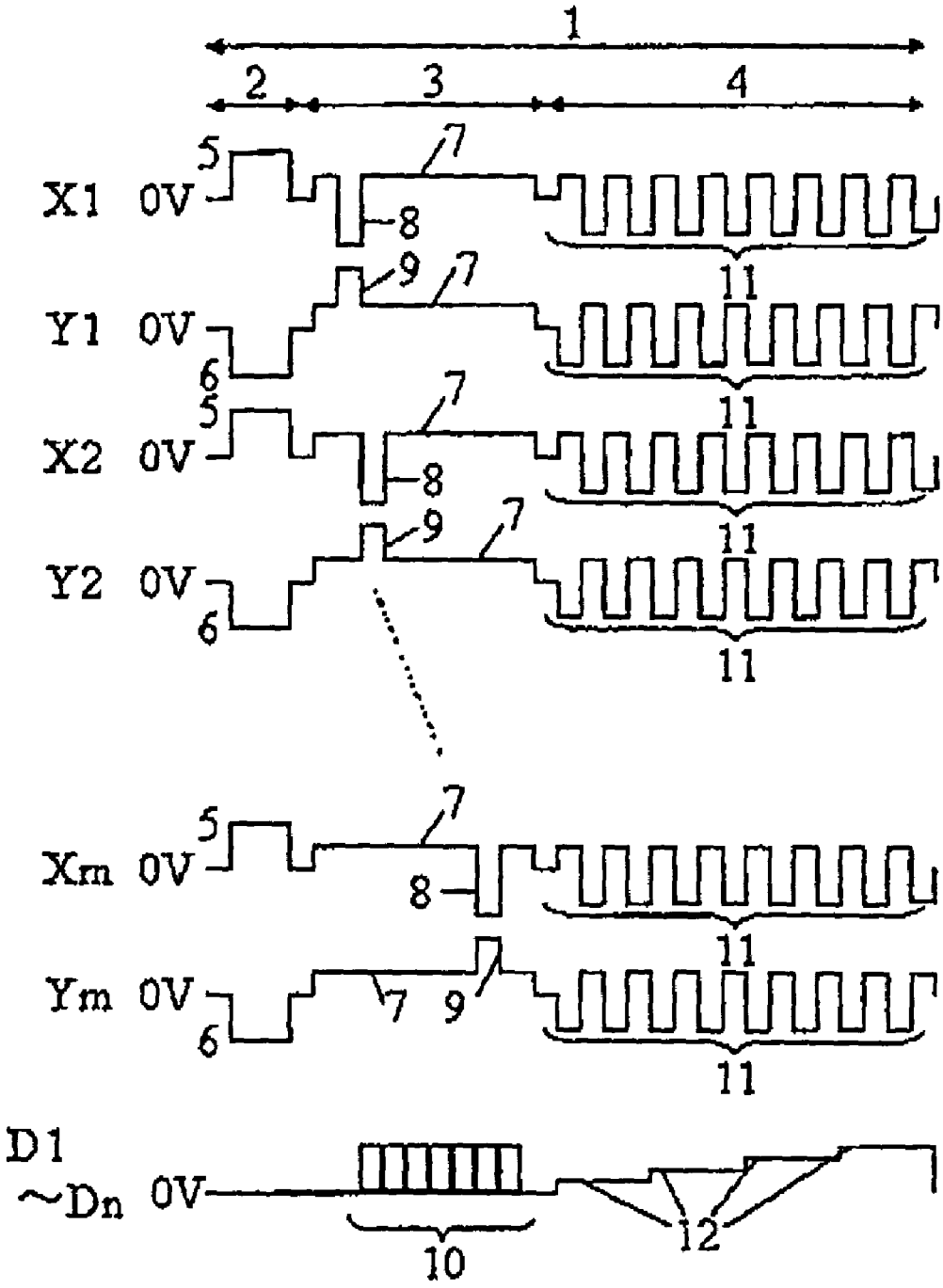
FIG. 5 is a diagram of waveforms explaining driving of a three-electrode AC-type PDP according to a second embodiment of the present invention.

A second embodiment of the present invention is described with reference to FIG. 5. Configurations of a panel and a cell of this embodiment are the same as those in the case of the first embodiment. Methods for driving the AC-type PDP of the second embodiment are also the same as those in the case of the first embodiment except that a voltage of sustaining discharge control signal 12 during a sustaining period 4 rises gradually and step by step.

Figure 6:
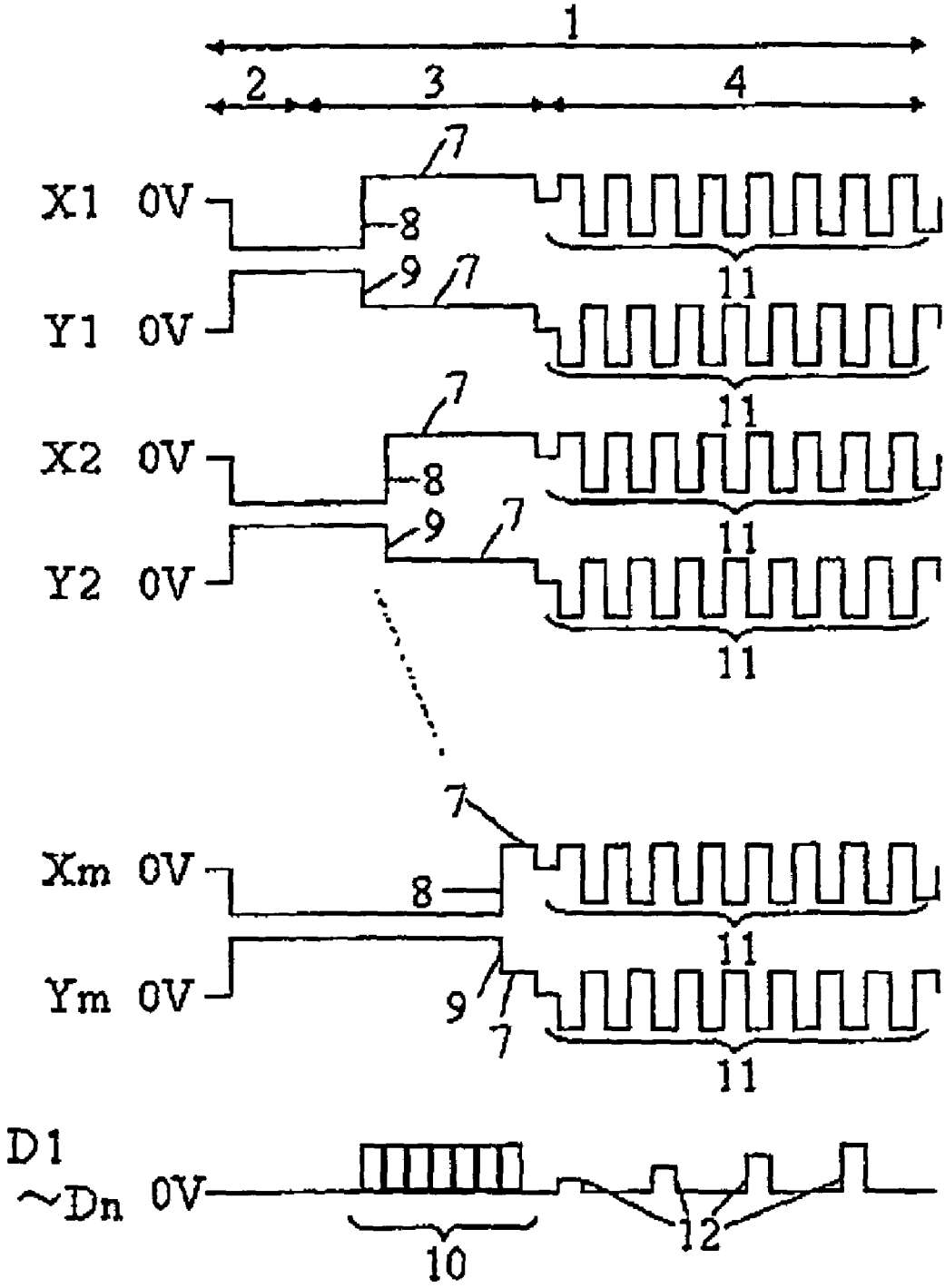
FIG. 6 is a diagram of waveforms explaining driving of a three-electrode AC-type PDP according to a third embodiment of the present invention.

A third embodiment of the present invention is described with reference to FIG. 6. Configurations of a panel and a cell of this embodiment are the same as those in the case of the first embodiment. In the present embodiment, a wall charge produced in a preliminary discharge is directly used in extinguishing discharge at a time of writing such that a preliminary discharge pulse and a scanning pulse are integrally combined. Accordingly, discharge of two times in the preliminary discharge occurs, and discharge of two times in the writing discharge occurs in the first and second embodiments of the present invention. In the present embodiment, discharge of two times in total suffices. As a result, the luminance of the display of black (no sustaining discharge) can be reduced and the contrast can be improved.

Figure 7:
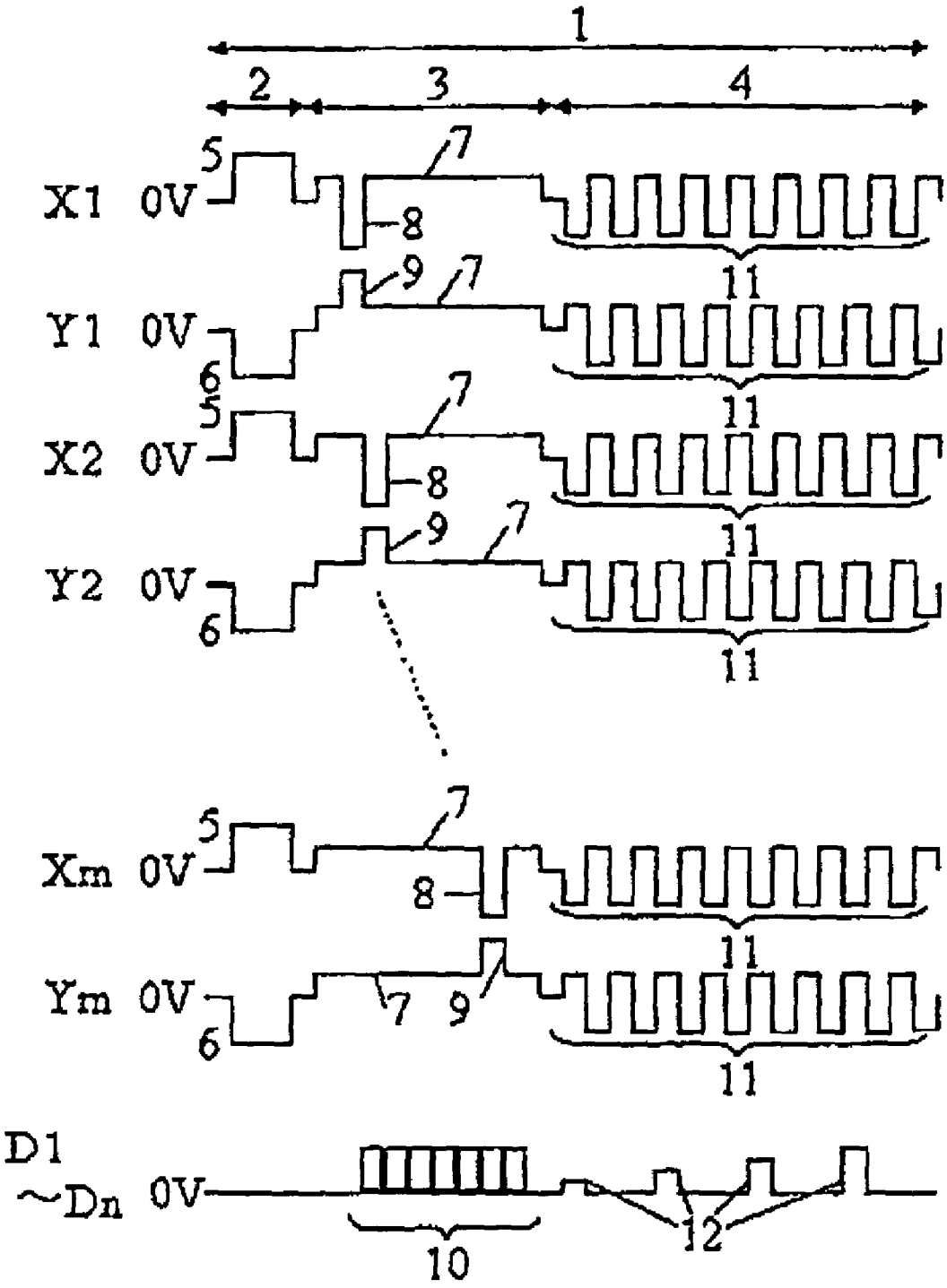
FIG. 7 is a diagram of waveforms explaining driving of a three-electrode AC-type PDP according to a fourth embodiment of the present invention.

A fourth embodiment of the present invention is described with reference to FIG. 7. Configurations of a panel and a cell, a preliminary discharge period 2, and a scanning period 3 of the present embodiment are the same as those in the case of the first embodiment. FIG. 7 shows waveforms on even field of the fourth embodiment. Waveforms on odd field are the same as those shown in FIG. 4. In FIGS. 4 and 7, during the sustaining period 4, the sustaining pulses are 180 degrees different in phase between the X electrode 22 and the Y electrode 23. In this way, the opposite discharge at taming of a start of the sustaining discharge is switched to the X electrode 22 and the data electrode 29 or to the Y electrode 23 and the data electrode 29. Damage due to the discharge is distributed to two different areas from one area by switching the opposite discharge every field, and thus the life of the panel can be increased.

INDUSTRIAL APPLICABILITY

As described above, according to the present invention, the wall charge of same amount is produced in both the X electrode and the Y electrode during the scanning period and, at this time, the amount of wall charge for writing is adjusted depending on gradation sequence to be displayed. Furthermore, the gray shade is displayed such that, during the sustaining period, a sustaining discharge start control voltage as a voltage of the data electrode is changed and that timing of a start of a sustaining discharge is changed depending on the amount of a wall charge.

In this way, there is no voltage restrictions due to the sustaining pulse voltage different from the conventional example, and the range of the sustaining discharge start control voltage, that is, the range of the data electrode can be increased. Furthermore, the voltage of the sustaining pulse 11 is constant during the sustaining period, and weak and unstable sustaining discharge around the minimum sustaining voltage is not required to be used. Moreover, flicker in display is reduced and luminance of the gradation sequence can be simply decided by the number of sustaining pulses.

What is claimed is:

1. A method for driving an alternating current-type plasma display panel comprising the steps of:

mounting X electrodes and Y electrodes on one of two insulating substrates placed opposite to each other so as to be disposed alternately and parallel to each other;

mounting data electrodes on the other of the two insulating substrates so as to be perpendicular to both the X electrodes and the Y electrodes;

forming pixels at intersection of the X electrodes and Y electrodes and the data electrodes in a matrix form;

inducing sequentially, during a scanning period, writing discharge for producing wall charges based on gradation sequence to be displayed;

inducing sustaining discharge by applying, during a sustaining period, a sustaining pulse for inducing light emitting for displaying alternately to each of the X electrodes and each of the Y electrodes based on the wall charges; and applying during the scanning period a voltage of same polarity and same level to the X electrode and Y electrode of the pixels at timing when a data pulse corresponding to gradation sequence to be displayed of the pixels in applied to the data electrodes.

2. A method for driving an alternating current-type plasma display panel comprising the steps of:

mounting X electrodes and Y electrodes on one of two insulating substrates placed opposite L each other so as to be disposed alternately and parallel to each other;

mounting data electrodes on the other of the two insulating substrates so as to be perpendicular to both the X electrodes and the Y electrodes;

forming pixels at intersections of the X electrodes and Y electrodes and the data electrodes in a matrix form;

inducing sequentially, during a scanning period, writing discharge for producing wall charges based on gradation sequence to be displayed;

inducing sustaining discharge by applying, during a sustaining period, a sustaining pulse for inducing light emitting for displaying alternately to each of the X electrodes and each of the Y electrodes based on the wall charges; and producing, during the scanning period, a wall charge of same polarity and same amount in the X electrode and the Y electrode of the pixels.

3. A method for driving an alternating current-type plasma display panel comprising the steps of:

mounting X electrodes and Y electrodes on one of two insulating substrates placed opposite to each other so as to be disposed alternately and parallel to each others mounting data electrodes on the other of the two insulating substrates so as to be perpendicular to both the X electrodes and the Y electrodes;

forming pixels at intersections of the X electrodes and Y electrodes and the data electrodes in a matrix form;

inducing sequentially, during a scanning period, writing discharge for producing wall charges based on gradation sequence to be displayed;

inducing sustaining discharge by applying, during a sustaining period, a sustaining pulse for inducing light emitting for displaying alternately to each of the X electrodes and each of the Y electrodes based on the wall charges; and wherein a voltage of the wall charge produced in the X electrode and the Y electrode of the pixels during the scanning period, is the voltage which does not induce surface discharge between the X electrode and the Y electrode, even if a voltage of the sustaining pulse is added to the voltage of the wall charge.

4. A method for driving an alternating current-type plasma display panel as claimed in claims 1 to 3, wherein:

by the sustaining pulse applied at an initial stage of the sustaining period, opposite discharge occurs between the data electrode and either of the X electrode and the Y electrode in lighting pixels and no discharge occurs in non-lighting pixels.

5. A method for driving an alternating current-type plasma display panel as claimed in claims 1 to 3, further comprising the steps of:

making different depending on gradation sequence to be displayed a voltage of the data pulse applied to the data electrode at a time of the writing discharge in the scanning period;

adjusting an amount of the wall charge produced by the writing discharge; and displaying gradation sequence such that, during the sustaining period, a potential of the data electrode is changed and timing of a start of the sustaining discharge is changed depending on the gradation sequence.

6. A method for driving an alternating current-type plasma display panel as claimed in claim 5, wherein:

during the sustaining period discharge at timing of a start of the sustaining discharge depending on gradation sequence is the opposite discharge between the X electrode and the data electrode or the Y electrode and the data electrode.

7. A method for driving an alternating current-type plasma display panel as claimed in claim 6, wherein:

the data electrode is positive in the opposite discharge.

8. A method for driving alternating current-type plasma display panel as claimed in claims 1 to 3, wherein:

wall charges are produced in the X electrode and the Y electrode before the writing discharge in the scanning period occurs and the writing discharge is caused to occur by extinguishing writing to adjust the wall charges at a time when the data pulse is applied.

9. a method for driving an alternating current-type plasma display panel as claimed in claim 10, wherein:

wall charges are produced in the X electrode and the Y electrode by surface discharge between the X electrode and the X electrode before the writing discharge occurs in the scanning period.

10. A method for driving an alternating current-type plasma display panel as claimed in claims 1 to 3, wherein:

the X electrode and the Y electrode are at a same potential when the data pulse is applied for inducing the writing discharge.

11. A method for driving an alternating current-type plasma display panel as claimed in claims 1 to 3, wherein:

a potential difference between the electrodes where the opposite discharge occurs at timing of a start of the sustaining discharge is increased gradually during the sustaining period.

12. A method for driving an alternating current-type plasma display panel as claimed in claim 11, wherein:

the sustaining pulse voltage is constant and a potential difference between the electrodes where the opposite discharge occurs at timing of a start of the sustaining discharge is increased gradually during the sustaining period by changing a potential of the data electrode.

13. A method for driving an alternating current-type plasma display panel as claimed in claim 11, wherein:

a potential difference between the electrodes where the opposite discharge occurs at timing of a start of the sustaining discharge is increased gradually by changing, step by step, the potential of the data electrode during the sustaining period.

14. A method for driving an alternating current-type plasma display panel as claimed in claim 13, wherein:

a potential of the data electrode except timing of a start of the sustaining discharge is set between a potential of the data electrode at timing of a start of an initial sustaining discharge during the sustaining period and a potential of the sustaining pulse.

15. A method for driving an alternating current-type plasma display panel as claimed in claim 13, wherein:

a potential of the data electrode changing step by step and a potential of the data pulse applied during the scanning period are made common.

16. A method for driving an alternating current-type plasma display panel as claimed in claims 1 to 3, wherein:

each of the preliminary discharge period which resets the wall charge in the sustaining period, the scanning period and the sustaining period is defined as one sub-field, and a plurality of the sub-fields makes up one field to display one screen.

17. A method of driving an alternating current-type plasma display panel as claimed in claim 16, wherein:

each of the sustaining periods responsive to each of the sub-field respectively has sustaining pulses in different number.

18. A method for driving an alternating current-type plasma display panel as claimed in claim 16, wherein:

the number of sustaining pulses in each of the sub-fields in the one field during a period from a start of the sustaining discharge to an end of the sustaining period, is all different in the one field.

19. A method for driving an alternating current-type plasma display panel as claimed in claims 1 to 3, wherein:

a with of the sustaining pulse at timing of a start of the sustaining discharge is wider than a width of the other sustaining pulses.

20. A method for driving an alternating current-type plasma display panel as claimed in claim 14, wherein:

a potential of the data electrode changing step by step and a potential of the data pulse applied during the scanning period are made common.

21. A method for driving an alternating current-type plasma display panel as claimed in claim 17, wherein:

the number of sustaining pulses in each of the subfields in the one field during a period from a start of the sustaining discharge to an end of the sustaining period, is all different in the one field.

* * * * *